US009118157B2

(12) United States Patent
Miyaki

(10) Patent No.: US 9,118,157 B2
(45) Date of Patent: Aug. 25, 2015

(54) ELECTRICAL CONNECTOR

(71) Applicant: Hirose Electric Co., Ltd., Tokyo (JP)

(72) Inventor: Takashi Miyaki, Tokyo (JP)

(73) Assignee: HIROSE ELECTRIC CO., LTD., Tokyo (JP)

( * ) Notice: Subject to any disclaimer, the term of this patent is extended or adjusted under 35 U.S.C. 154(b) by 0 days.

(21) Appl. No.: 14/219,027

(22) Filed: Mar. 19, 2014

(65) Prior Publication Data

US 2014/0295681 A1 Oct. 2, 2014

(30) Foreign Application Priority Data

Mar. 26, 2013 (JP) ..... 2013-064004

(51) Int. Cl.
*H01R 12/00* (2006.01)
*H01R 24/84* (2011.01)

(52) U.S. Cl.
CPC ..... *H01R 24/84* (2013.01)

(58) Field of Classification Search
CPC ..... H01R 24/84; H01R 24/86; H01R 12/732; H01R 12/728; H01R 12/73
USPC ..... 439/65
See application file for complete search history.

(56) References Cited

U.S. PATENT DOCUMENTS 8,454,397 B2 * 6/2013 Nishi et al. ..... 439/876
2004/0029410 A1 * 2/2004 Akama et al. ..... 439/65
2012/0149216 A1 * 6/2012 Weng ..... 439/65

FOREIGN PATENT DOCUMENTS

JP 2010-272291 A 12/2010

* cited by examiner

*Primary Examiner* — Jean F Duverne
(74) *Attorney, Agent, or Firm* — Kubotera & Associates, LLC

(57) ABSTRACT

An electrical connector is to be connected to a mating electrical connector in a connecting direction. The electrical connector includes a terminal; and a housing for holding the terminal. The terminal includes a board connecting portion to be connected to a board; a holding portion fixed to the housing; a contact region for contacting a mating contact portion of the mating electrical connector; a contact piece capable of elastically deforming; and a contact portion formed at a distal end portion of the contact piece. The housing includes an inner piece portion and an outer piece portion. The contact piece is disposed between the inner piece portion and the outer piece portion. The outer piece portion includes inner piece holding portions at both sides thereof. The inner piece holding portions are away from each other by a distance greater than a width of the inner piece portion.

6 Claims, 10 Drawing Sheets

ELECTRICAL CONNECTOR

BACKGROUND OF THE INVENTION AND RELATED ART STATEMENT

The present invention relates to an electrical connector. More specifically, the present invention relates to an inter-board electrical connector for connecting a circuit board.

A conventional inter-board electrical connector has been used for electrically connecting circuit boards arranged on a same plane. For example, Patent Reference has disclosed a configuration of the conventional inter-board electrical connector. The conventional inter-board electrical connector disclosed in Patent Reference includes a male connector and a female connector mounted on the circuit boards. In this case, the male connector has a shape difference from that of the female connector. The male connector is configured to connect to the female connector, so that the circuit boards are electrically connected to each other.

Patent Reference: Japanese Patent Publication No. 2010-272291

In the conventional inter-board electrical connector disclosed in Patent Reference, the male connector and the female connector are mounted on and fixed to the circuit boards. Then, the male connector is connected to the female connector, so that the circuit boards are electrically connected to each other. Accordingly, if the male connector is even slightly shifted relative to the female connector on the circuit boards, it is difficult to properly connect the male connector to the female connector. Therefore, it is necessary to accurately mount the male connector and the female connector on the circuit boards. For this reason, if the male connector and the female connector mounted on the circuit boards are connected with some flexibility, it is convenient when the male connector is connected to the female connector.

Further, in the conventional inter-board electrical connector disclosed in Patent Reference, the male connector has the different shape from that of the female connector. Accordingly, it is necessary to produce the male connector and the female connector separately, thereby making it difficult to reduce the production cost and the assembly cost.

In view of the problems described above, an object of the present invention is to provide a electrical connector and an image forming apparatus capable of solving the problems of the conventional electrical connector and the conventional image forming apparatus. In the present invention, it is possible to reduce a stain generated on a sheet.

Further objects and advantages of the invention will be apparent from the following description of the invention.

SUMMARY OF THE INVENTION

In order to attain the objects described above, according to an aspect of the present invention, an electrical connector is provided for electrically connecting circuit boards. The electrical connector is an electrical connector, in which a male connector and a female connector have a same shape, capable of connecting to another electrical connector having a same shape.

According to the aspect of the present invention, the electrical connector includes a terminal formed of a conductive material and a housing formed of an insulation material for holding the terminal.

According to the aspect of the present invention, the terminal includes a board connecting portion to be connected to a circuit on the circuit board; a holding portion fixed to the housing; a contact region extending from the holding portion; a contact piece extending from the contact region and capable of elastically deforming; and a contact portion formed at a distal end portion of the contact piece.

According to the aspect of the present invention, when the electrical connector is connected to another electrical connector, the contact region of the electrical connector contacts with a contact portion of another electrical connector. Further, the contact portion of the electrical connector contacts with a contact region of another electrical connector, so that the terminal of the electrical connector is electrically connected to a terminal of another electrical connector.

According to the aspect of the present invention, the housing includes an inner piece portion and an outer piece portion protruding in parallel to a connecting direction of the housing. The contact piece of the terminal is disposed between the inner piece portion and the outer piece portion. The contact piece of the terminal is arranged along a connecting direction of the inner piece portion. The outer piece portion includes an inner piece holding portion extending from both sides thereof toward the inner piece portion in a curved shape. The inner piece holding portions at the both sides of the outer piece portion are away from each other by a distance greater than a width of the inner piece portion.

In the electrical connector of the present invention, it is possible to obtain the following effects. First, it is possible to increase flexibility in terms of a relative position of the electrical connector and another electrical connector while securing electrical connection between the electrical connector and another electrical connector.

Second, the electrical connector and another electrical connector are the male connector and the female connector having the substantially same shape. Accordingly, it is possible to easily produce and assemble the electrical connector and another electrical connector, thereby decreasing a manufacturing and assembling cost.

DETAILED DESCRIPTION OF PREFERRED EMBODIMENTS

Figure 1:
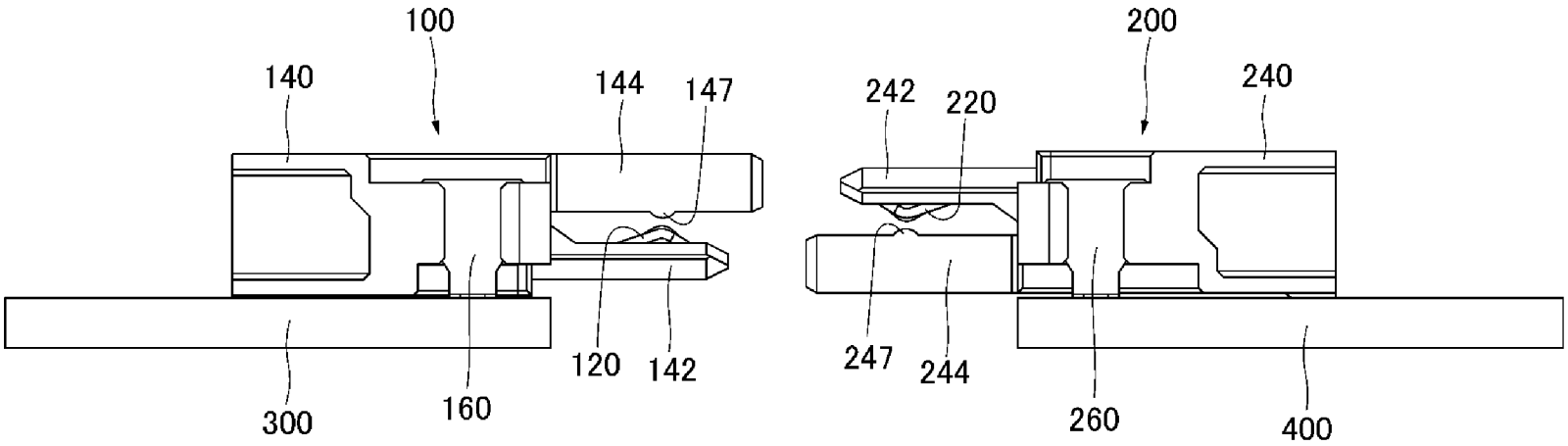
FIG. 1 is a schematic side view showing a configuration of an electrical connector according to an embodiment of the present invention.

Hereunder, embodiments of the present invention will be explained with reference to the accompanying drawings. It should be noted that the present invention is not limited to the following description, and the embodiments can be modified within a scope of the present invention. In the following description, same reference numerals are assigned to similar components, and redundant explanations thereof are omitted.

FIG. 1 is a schematic side view showing an electrical connector 100 and an electrical connector 200 in a connection state before the electrical connector 100 is connected to the electrical connector 200 according to the embodiment of the present invention. First, a configuration of the electrical connector 100 and the electrical connector 200 will be explained with reference to FIG. 1.

In the embodiment, the electrical connector 100 and the electrical connector 200 are connectors (an inter-board electrical connector) for electrically connecting circuit boards 300 and 400 arranged on a same plane. More specifically, the electrical connector 100 and the electrical connector 200 are electrical connector for electrically connecting circuit boards disposed in a device such as an LED (Light Emitting Diode) light. The electrical connector 100 and the electrical connector 200 are mounted on the circuit board 300 and the circuit board 400 near edge portions thereof, so that connecting portions of the electrical connector 100 and the electrical connector 200 protrude from the edge portions of the circuit board 300 and the circuit board 400, respectively.

In the embodiment, the electrical connector 100 includes a terminal 120; a housing 140; a reinforcing metal member 160; and the like. Similarly, the electrical connector 200 includes a terminal 220; a housing 240; a reinforcing metal member 260; and the like. It should be noted that it is not necessary to provide the reinforcing metal member 160 and the reinforcing metal member 260, and the reinforcing metal member 160 and the reinforcing metal member 260 may be provided as necessary. It is also noted that the electrical connector 100 and the electrical connector 200 are electrical connector including the housing 140 and the housing 240 having a same shape, i.e., a same male-female shape.

In the embodiment, the electrical connector 200 has the same shape as that of the electrical connector 100 rotated by 180 degree relative to the sheet plane of FIG. 1. The terminal 220 of the electrical connector 200 has a similar shape to that of the terminal 120 of the electrical connector 100 except a portion thereof (a board connecting portion 221) to be connected to a circuit on the circuit board 400 is curved in an opposite direction. Further, the reinforcing metal member 160 of the electrical connector 100 for fixing the electrical connector 100 to the circuit board 300 has a similar shape as that of the reinforcing metal member 260 of the electrical connector 200 for fixing the electrical connector 200 to the circuit board 400 except the reinforcing metal member 160 is attached to the housing 140 in an opposite direction to that of the reinforcing metal member 260 relative to the housing 240.

With the configuration described above, it is possible to produce the housing 140, the terminal 120, and the reinforcing metal member 160 of the electrical connector 100 using a same mold as that for producing the housing 240, the terminal 220, and the reinforcing metal member 260 of the electrical connector 200. Accordingly, it is possible to reduce the number of the components constituting the electrical connector 100 and the electrical connector 200.

When the terminal 120 of the electrical connector 100 is electrically connected to the terminal 220 of the electrical connector 200, first, the circuit board 300 and the circuit board 400 are placed on the same plane as shown in FIG. 1. Afterward, the circuit board 300 and the circuit board 400 are moved horizontally, so that the electrical connector 100 is connected to the electrical connector 200. When the electrical connector 100 is connected to the electrical connector 200, an inner piece portion 242 of the electrical connector 200 is inserted into an outer piece portion 144 of the electrical connector 100, and an inner piece portion 142 of the electrical connector 100 is inserted into an outer piece portion 244 of the electrical connector 200. Accordingly, when the electrical connector 100 is connected to the electrical connector 200, the terminal 120 of the electrical connector 100 contacts with and is electrically connected to the terminal 220 of the electrical connector 200.

In the embodiment, even after the electrical connector 100 is connected to the electrical connector 200, the electrical connector 100 is capable of shifting relative to the electrical connector 200 on the same plane (an X-Y plane) on the circuit board 300 and the circuit board 400 while maintaining the connection between the electrical connector 100 and the electrical connector 200. Accordingly, it is possible to maintain the electrical connection between the terminal 120 and the terminal 220.

In the embodiment, the outer piece portion 144 of the electrical connector 100 includes a protruding portion 147, and the outer piece portion 244 of the electrical connector 200 includes a protruding portion 247. The protruding portion 147 and the protruding portion 247 are provided for engaging with groove portions of the terminal 120 and the housing 240 of the electrical connector 100 and the electrical connector 200, respectively. Accordingly, it is possible to prevent the electrical connector 100 from being disconnected from the electrical connector 200 easily.

Figure 2:
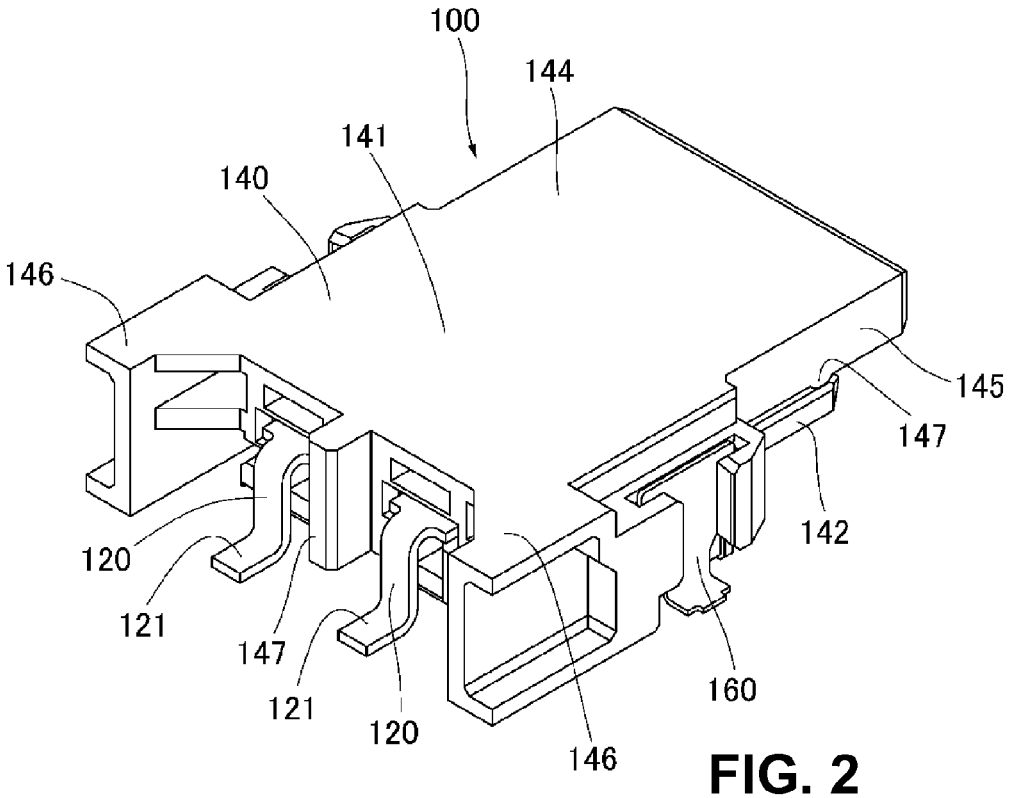
FIG. 2 is a schematic perspective view showing the configuration of the electrical connector according to the embodiment of the present invention.
Figure 3:
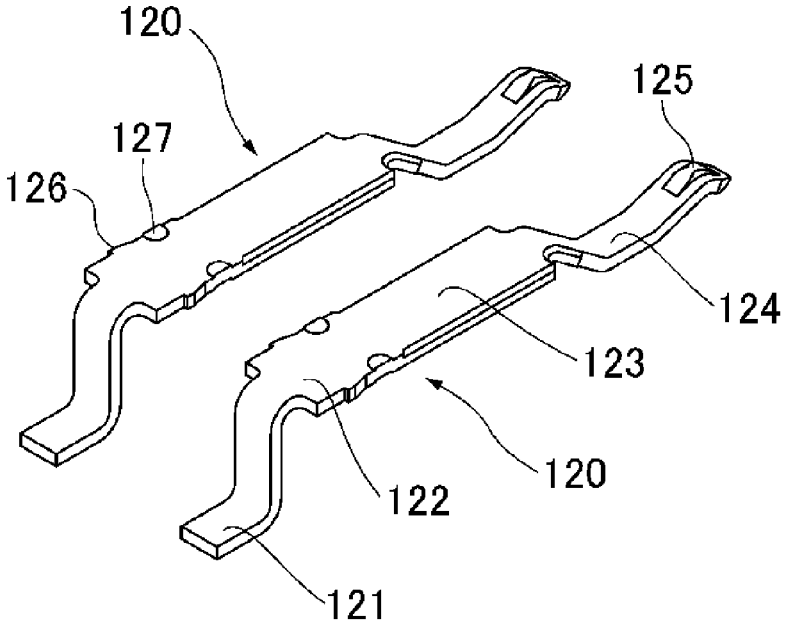
FIG. 3 is a schematic perspective view showing a terminal of the electrical connector according to the embodiment of the present invention.
Figure 4:
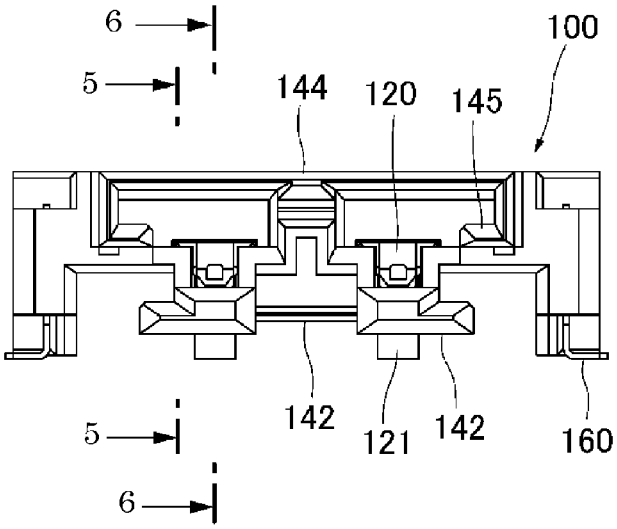
FIG. 4 is a schematic front view showing the electrical connector viewed from a connecting side according to the embodiment of the present invention.

FIG. 2 is a schematic perspective view showing the configuration of the electrical connector 100 according to the embodiment of the present invention. FIG. 3 is a schematic perspective view showing the terminal 120 of the electrical connector 100 according to the embodiment of the present invention. FIG. 4 is a schematic front view showing the electrical connector 100 viewed from a connecting side according to the embodiment of the present invention.

Figure 5:
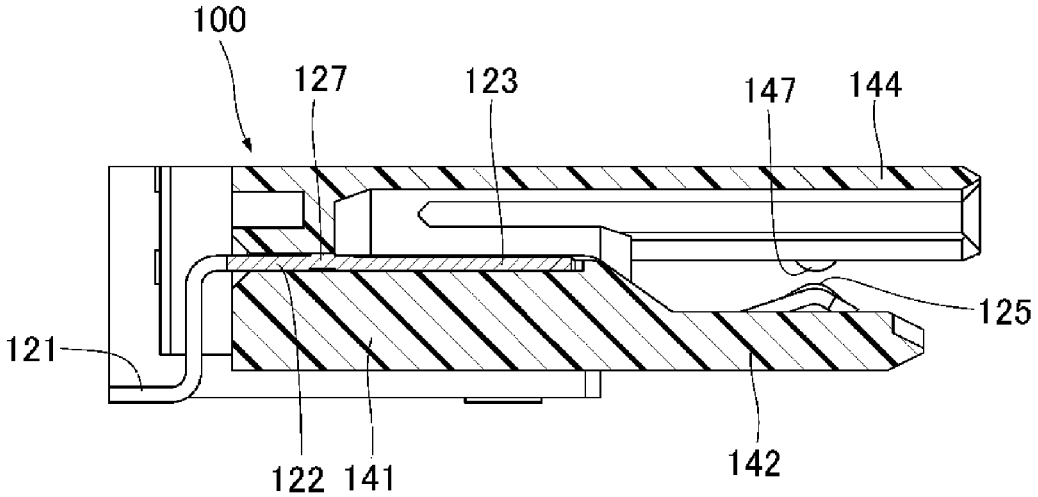
FIG. 5 is a schematic sectional view showing the electrical connector taken along a line 5-5 in FIG. 4 according to the embodiment of the present invention.
Figure 6:
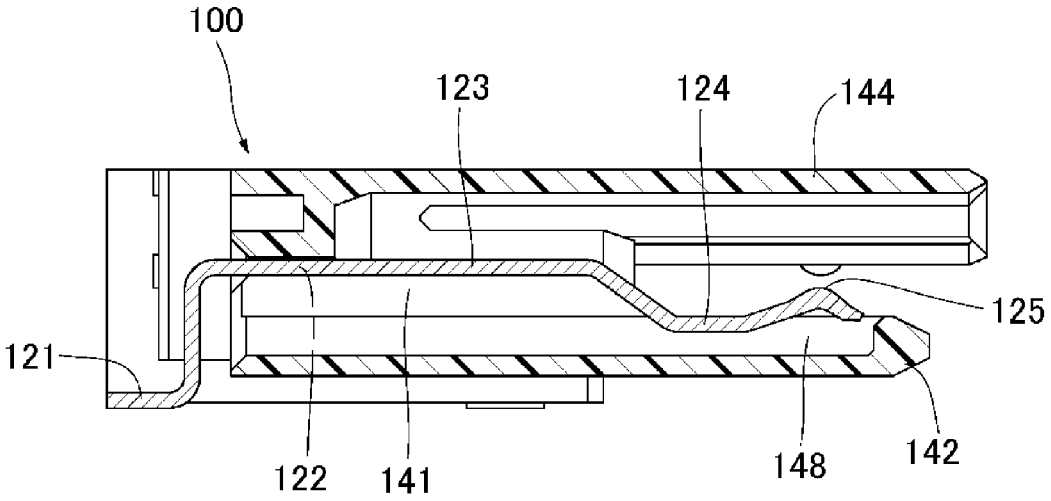
FIG. 6 is a schematic sectional view showing the electrical connector taken along a line 6-6 in FIG. 4 according to the embodiment of the present invention.

FIG. 5 is a schematic sectional view showing the electrical connector 100 taken along a line 5-5 in FIG. 4 according to the embodiment of the present invention. FIG. 6 is a schematic sectional view showing the electrical connector 100 taken along a line 6-6 in FIG. 4 according to the embodiment of the present invention.

The configuration of the electrical connector 100 will be explained next in more detail with reference to FIGS. 2 to 6. As described above, the electrical connector 100 includes the terminal 120 formed of a conductive material; the housing 140 formed of an insulation material for holding the terminal 120; and the reinforcing metal member 160 for fixing the electrical connector 100 to the circuit board 300. As described above, it is not necessary to provide the reinforcing metal member 160, and it is possible to omit the reinforcing metal member 160.

As shown in FIG. 3, the terminal 120 includes a board connecting portion (a mounting portion) 121 to be connected to the circuit on the circuit board 300; a holding portion (a fitting portion) 122 to be fitted into and fixed to the housing 140; a contact region 123 extending from the holding portion 122; a contact piece 124 extending from the contact region 123 and capable of elastically deforming; and a contact portion (a contact protruding portion) 125 formed at a distal end portion of the contact piece 124.

In the embodiment, the contact region 123 extends in the connecting direction of the electrical connector 100, and is formed to have a wide width in an arrangement direction of the terminal 120. Accordingly, when the electrical connector 100 is connected to the electrical connector 200, even if the electrical connector 100 is shifted (floating) relative to the electrical connector 200 on the same plane as that of the circuit board 300 and the circuit board 400, it is possible to maintain the electrical connection between the terminal 120 and the terminal 220.

In the embodiment, the holding portion 122 of the terminal 120 includes a fitting protruding portion 126 formed to protrude a width direction of the terminal 120. Further, the holding portion 122 of the terminal 120 includes a positioning protruding portion 127 on an upper surface thereof (an opposite surface to an elastically deforming direction of the contact piece 124 when the electrical connector 100 is connected to the electrical connector 200) at a fitting distal end side (a side of the contact piece 124) relative to the fitting protruding portion 126. The positioning protruding portion 127 is provided for positioning the terminal 120 in a vertical direction.

In the embodiment, the terminal 120 is fitted into the housing 140 such that the contact piece 124 becomes an advancing end portion in the fitting direction. More specifically, when the terminal 120 is fitted into the housing 140, the contact piece 124 is inserted first then the contact region 123 and the holding portion 122 in this order. It should be noted that the electrical connector 100 has two terminals 120 as an example, and the present invention is not limited thereto. The electrical connector 100 may have only one terminal 120 or more than three terminals 120. It should be noted that all of the terminals 120 has the same shape.

In the embodiment, the housing 140 includes a main body portion 141 to which the terminal 120 is fitted and fixed; and an inner piece portion 142 and an outer piece portion 144 extending in parallel to each other from the main body portion 141 toward the electrical connector 200 (the mating connector). The outer piece portion 144 includes an inner piece holding portion 145 extending from both sides thereof toward the inner piece portion 142. The inner piece holding portion 145 is formed in an open rectangular shape, and is provided for engaging with the inner piece portion 242 of the electrical connector 200. Accordingly, when the electrical connector 100 is connected to the electrical connector 200, the electrical connector 100 is positioned relative to the electrical connector 200 in the vertical direction, thereby preventing the electrical connector 100 from floating.

In the embodiment, the inner piece holding portion 145 disposed on the both sides of the outer piece portion 144 has inner side surfaces apart from each other by a distance greater than the width of the inner piece portion 142. Accordingly, when the electrical connector 100 is connected to the electrical connector 200, the electrical connector 100 is capable of shifting relative to the electrical connector 200 in a lateral direction (a direction perpendicular to the connecting direction) while maintaining the electrical connection between the terminal 120 of the electrical connector 100 and the terminal 220 of the electrical connector 200.

In the embodiment, the inner piece portion 142 holds the terminal 120 such that the contact region 123 of the terminal 120 contacts with an upper surface of the inner piece portion 142. Further, the contact piece 124 of the terminal 120 is disposed between the inner piece portion 142 and the outer piece portion 144, and a distal end portion thereof (near the contact portion 125) is situated slightly above the inner piece portion 142, so that the contact piece 124 is capable of elastically deforming. Further, a displacement space 148 is formed between the contact piece 124 and the inner piece portion 142, so that the contact piece 124 is capable of elastically deforming in the displacement space 148.

In the embodiment, when the electrical connector 100 is connected to the electrical connector 200, the outer piece portion 144 is situated outside the electrical connector 200. Further, a position stabilizing portion 146 extends from the main body portion 141 of the housing 140 on a side of the board connecting portion 121 of the terminal 120 such that the position stabilizing portion 146 surrounds the board connecting portion 121. Accordingly, when the circuit board 300 is twisted or strained, it is possible to reduce a negative effect on the board connecting portion 121 (for example, a force applied to the connecting portion between the board connecting portion 121 and the circuit board 300). Further, a protruding portion 147 protruding from the main body portion 141 is disposed between the board connecting portions 121 of the terminals 120. The protruding portion 147 is provided for securing a separation distance between the terminals 120.

Figure 7:
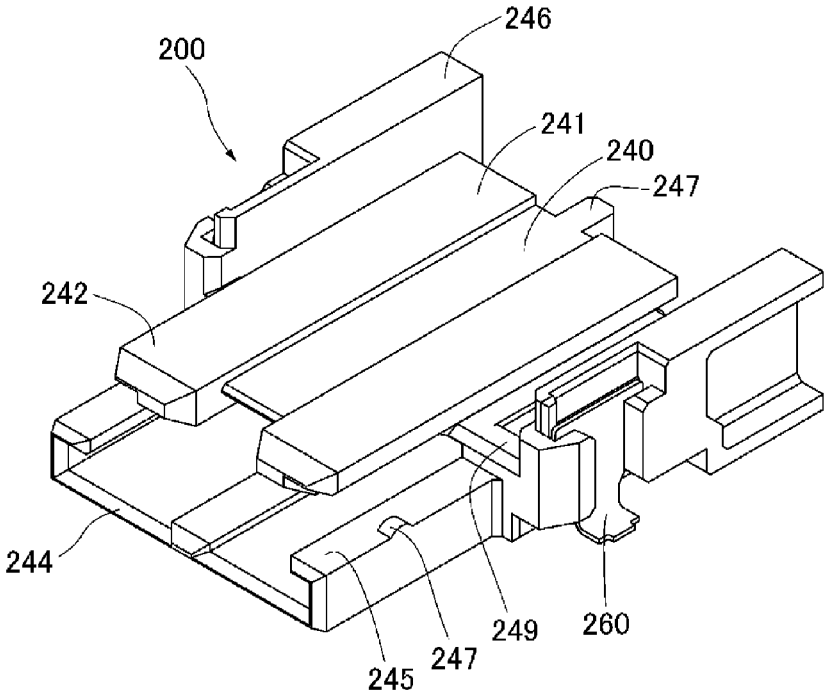
FIG. 7 is a schematic perspective view showing the configuration of the electrical connector according to the embodiment of the present invention.
Figure 8:
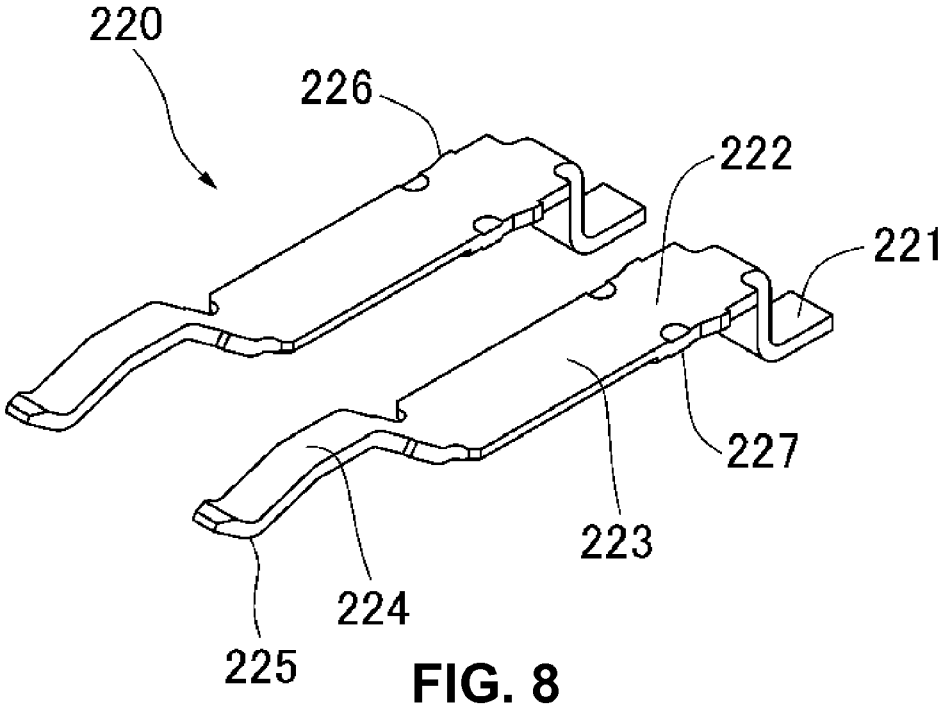
FIG. 8 is a schematic perspective view showing a terminal of the electrical connector according to the embodiment of the present invention.

FIG. 7 is a schematic perspective view showing the configuration of the electrical connector 200 according to the embodiment of the present invention. FIG. 8 is a schematic perspective view showing the terminal 220 of the electrical connector 200 according to the embodiment of the present invention.

As shown in FIG. 7, the electrical connector 200 includes the terminal 220 formed of a conductive material; the housing 240 formed of an insulation material for holding the terminal 220; and the reinforcing metal member 260 for fixing the electrical connector 200 to the circuit board 400.

As shown in FIG. 8, the terminal 220 includes a board connecting portion (a mounting portion) 221 to be connected to the circuit on the circuit board 400; a holding portion (a fitting portion) 222 to be fitted into and fixed to the housing 240; a contact region 223 extending from the holding portion 222; a contact piece 224 extending from the contact region 223 and capable of elastically deforming; and a contact portion (a contact protruding portion) 225 formed at a distal end portion of the contact piece 224. It should be noted that the electrical connector 200 has two terminals 220 as an example, and the present invention is not limited thereto. The electrical connector 200 may have only one terminal 220 or more than three terminals 220. It should be noted that all of the terminals 220 has the same shape.

In the embodiment, the housing 240 includes a main body portion 241 to which the terminal 220 is fitted and fixed; and an inner piece portion 242 and an outer piece portion 244 extending in parallel to each other from the main body portion 241 toward the electrical connector 100 (the mating connector). The outer piece portion 244 includes an inner piece holding portion 245 extending from both sides thereof toward the inner piece portion 242. The inner piece holding portion 245 is formed in an open rectangular shape, and is provided for engaging with the inner piece portion 142 of the electrical connector 100. Accordingly, when the electrical connector 100 is connected to the electrical connector 200, the electrical connector 100 is positioned relative to the electrical connector 200 in the vertical direction, thereby preventing the electrical connector 100 from floating.

In the embodiment, the electrical connector 200 has the similar configuration to that of the electrical connector 100. More specifically, the electrical connector 200 has the similar configuration except the board connecting portion 221 of the terminal 220 is curved in the opposite direction, and the reinforcing metal member 260 of the terminal 220 is attached in the opposite direction. Accordingly, the detailed explanation of the configuration of the electrical connector 200 is omitted.

In the embodiment, when the electrical connector 100 is connected to the electrical connector 200, the contact portion 225 of the electrical connector 200 contacts with the contact region 123 of the electrical connector 100, and the contact portion 125 of the electrical connector 100 contacts with the contact region 223 of the electrical connector 200, so that the terminal 120 is electrically connected to the terminal 220. Further, when the electrical connector 100 is connected to the electrical connector 200, the inner piece portion 242 of the electrical connector 200 is inserted into the inner piece holding portion 145 of the outer piece portion 144 of the electrical connector 100, and the inner piece portion 142 of the electrical connector 100 is inserted into the inner piece holding portion 245 of the outer piece portion 244 of the electrical connector 200.

As described above, after the electrical connector 100 is connected to the electrical connector 200 and the terminal 120 is electrically connected to the terminal 220, the electrical connector 100 is capable of shifting relative to the electrical connector 200 within a specific range (x1, y1; described later) while maintaining the electrical connection between the terminal 120 and the terminal 220. More specifically, even when the electrical connector 100 is shifted relative to the electrical connector 200 within the specific range (x1, y1) on the same plane as that of the circuit board 300 and the circuit board 400, it is possible to secure the electrical connection between the terminal 120 and the terminal 220. In other words, the electrical connector 100 and the electrical connector 200 are configured to define the specific range (x1, y1).

Figure 9:
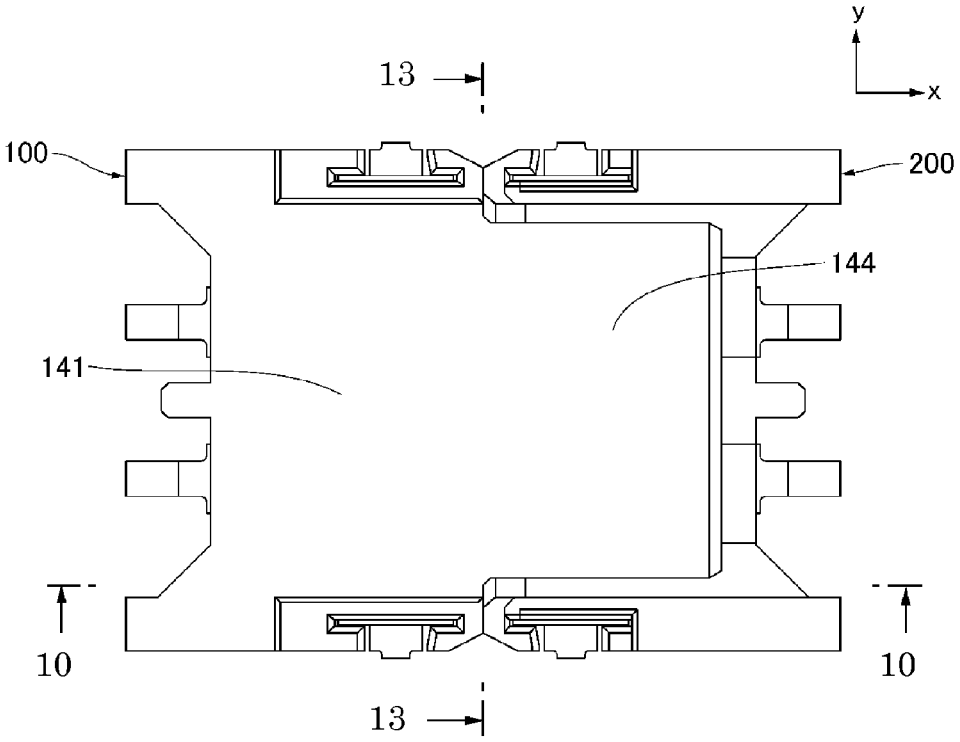
FIG. 9 is a schematic plane view showing the electrical connector in a connection state that the electrical connector is connected to another electrical connector (inserted into a deepest position) according to the embodiment of the present invention.
Figure 10:
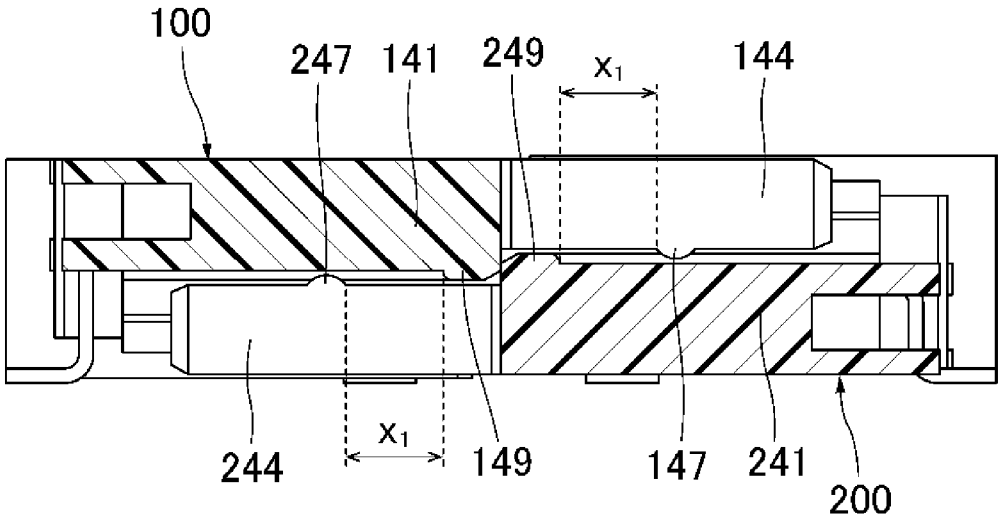
FIG. 10 is a schematic sectional view showing the electrical connector taken along a line 10-10 in FIG. 9 according to the embodiment of the present invention.
Figure 13:
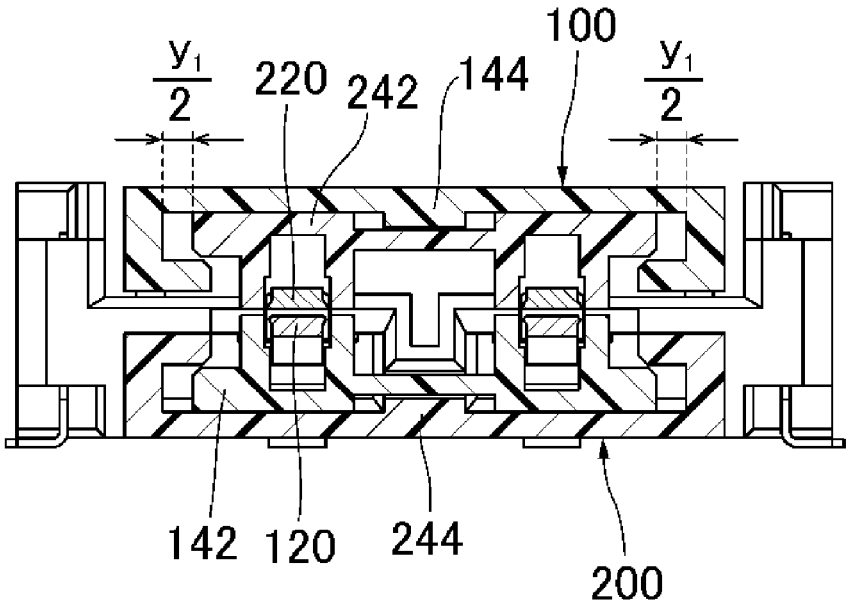
FIG. 13 is a schematic sectional view showing the electrical connector taken along a line 13-13 in FIG. 9 according to the embodiment of the present invention.

FIG. 9 is a schematic plane view showing the electrical connector 100 and the electrical connector 200 in a connection state that the electrical connector 100 is connected to the electrical connector 200 (inserted into a deepest position) according to the embodiment of the present invention. FIG. 10 is a schematic sectional view showing the electrical connector 100 and the electrical connector 200 taken along a line 10-10 in FIG. 9 according to the embodiment of the present invention. FIG. 13 is a schematic sectional view showing the electrical connector 100 and the electrical connector 200 taken along a line 13-13 in FIG. 9 according to the embodiment of the present invention.

Figure 18:
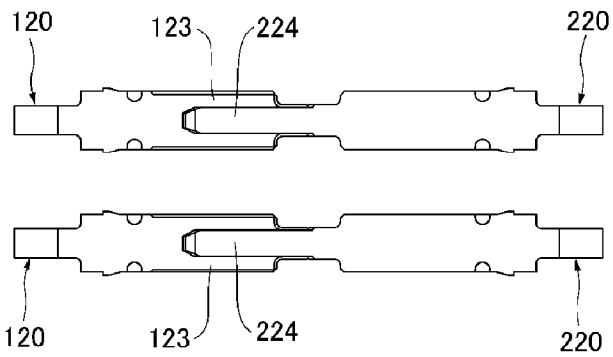
FIGS. 18(*a*) to 18(*d*) are schematic plan views showing the terminal of the electrical connector in a connection state that the terminal is arranged in a specific state (a floating state) when the electrical connector is connected to another electrical connector according to the embodiment of the present invention.
Figure 18:
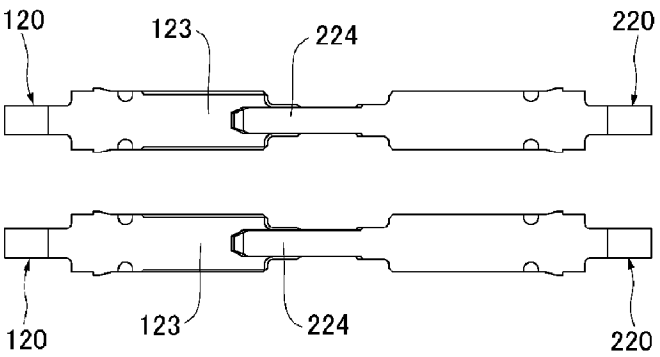
Figure 18:
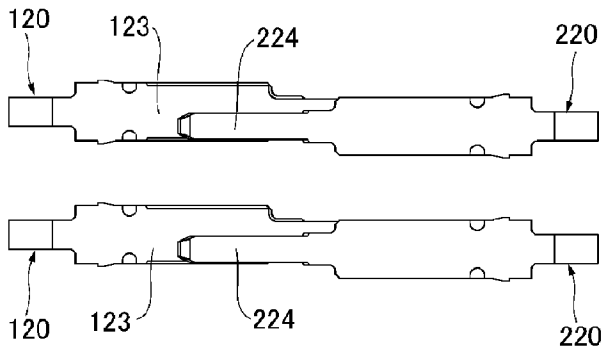
Figure 18:
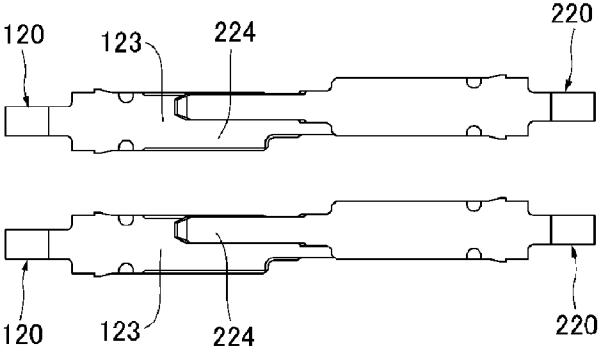

FIGS. 18(*a*) to 18(*d*) are schematic plan views showing the terminal 120 and the terminal 220 of the electrical connector 100 and the electrical connector 200 in a connection state that the terminal 120 and the terminal 220 are arranged in a specific state (the floating state) when the electrical connector 100 is connected to the electrical connector 200 according to the embodiment of the present invention.

As shown in FIG. 9, the electrical connector 100 is inserted into the electrical connector 200 up to the deepest position in the connecting direction (an x axis direction), and a center axis of the electrical connector 100 is aligned with that of the electrical connector 200 (the electrical connector 100 is not shifted relative to the electrical connector 200 in the terminal arrangement direction or a y axis direction). In this state, the terminal 120 and the terminal 220 are arranged in the specific positional arrangement as shown in FIG. 18(*a*).

Figure 11:
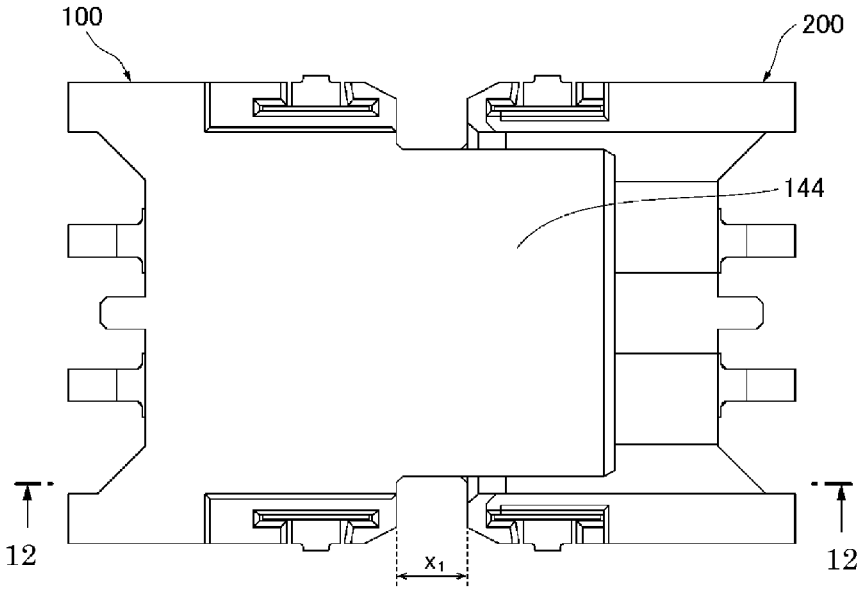
FIG. 11 is a schematic plane view showing the electrical connector in a connection state that the electrical connector is connected to another electrical connector (in a floating state in a connecting direction) according to the embodiment of the present invention.
Figure 12:
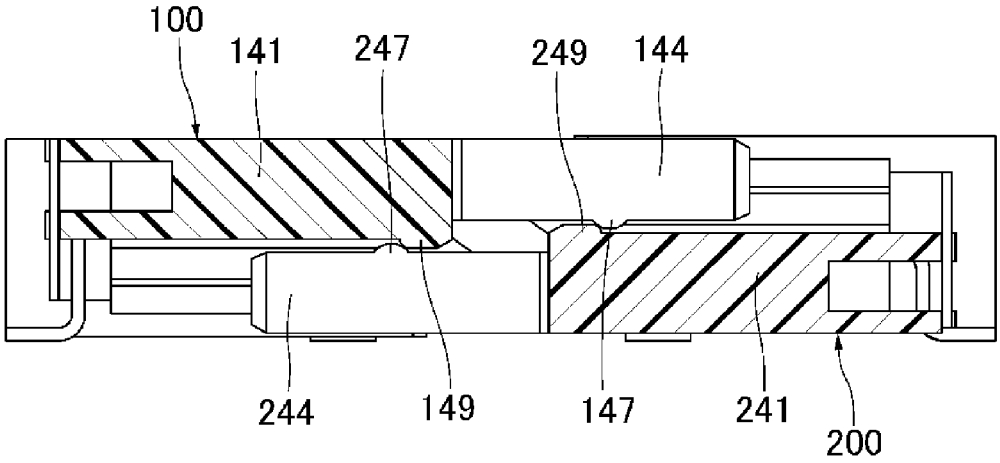
FIG. 12 is a schematic sectional view showing the electrical connector taken along a line 12-12 in FIG. 11 according to the embodiment of the present invention.

In the embodiment, after the electrical connector 100 is connected to the electrical connector 200 as shown in FIG. 9, when the electrical connector 100 is shifted relative to the electrical connector 200 by a specific distance x1, the electrical connector 100 and the electrical connector 200 are in a connection state as shown in FIGS. 11 and 12.

FIG. 11 is a schematic plane view showing the electrical connector 100 and the electrical connector 200 in the connection state that the electrical connector 100 is shifted relative to the electrical connector 200 (in the floating state in the connecting direction) according to the embodiment of the present invention. FIG. 12 is a schematic sectional view showing the electrical connector 100 and the electrical connector 200 taken along a line 12-12 in FIG. 11 according to the embodiment of the present invention.

As shown in FIG. 12, when the electrical connector 100 is shifted relative to the electrical connector 200 by the specific distance x1, the protruding portion 147 of the electrical connector 100 engages with a protruding portion 249 of the electrical connector 200, and the protruding portion 247 of the electrical connector 200 engages with a protruding portion 149 of the electrical connector 100. Accordingly, the floating state of the electrical connector 100 and the electrical connector 200 in the connecting direction is restricted. In this state, the terminal 120 and the terminal 220 are arranged in the specific positional arrangement as shown in FIG. 18(*b*). As shown in FIG. 18(*b*), in this state, the contact portion 225 of the electrical connector 200 contacts with the contact region 123 of the electrical connector 100, and the contact portion 125 of the electrical connector 100 contacts with the contact region 223 of the electrical connector 200, so that the terminal 120 is electrically connected to the terminal 220 (the electrical connection between the terminal 120 and the terminal 220 is maintained).

Figure 14:
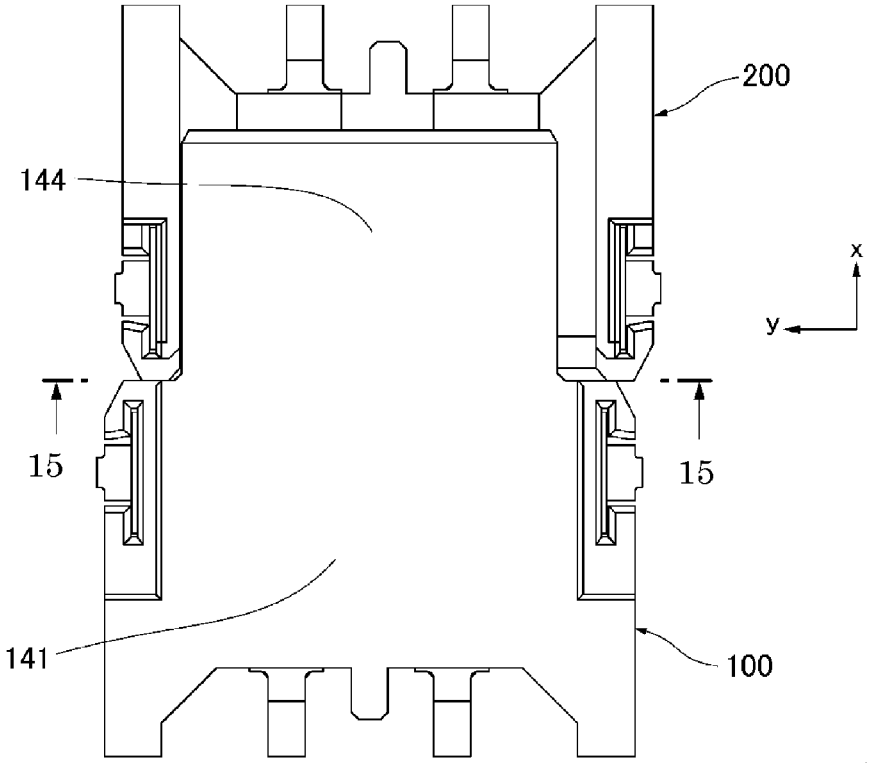
FIG. 14 is a schematic plane view showing the electrical connector in a connection state that the electrical connector is connected to another electrical connector (in a floating state in a left direction relative to an arrangement direction of the terminal) according to the embodiment of the present invention.
Figure 15:
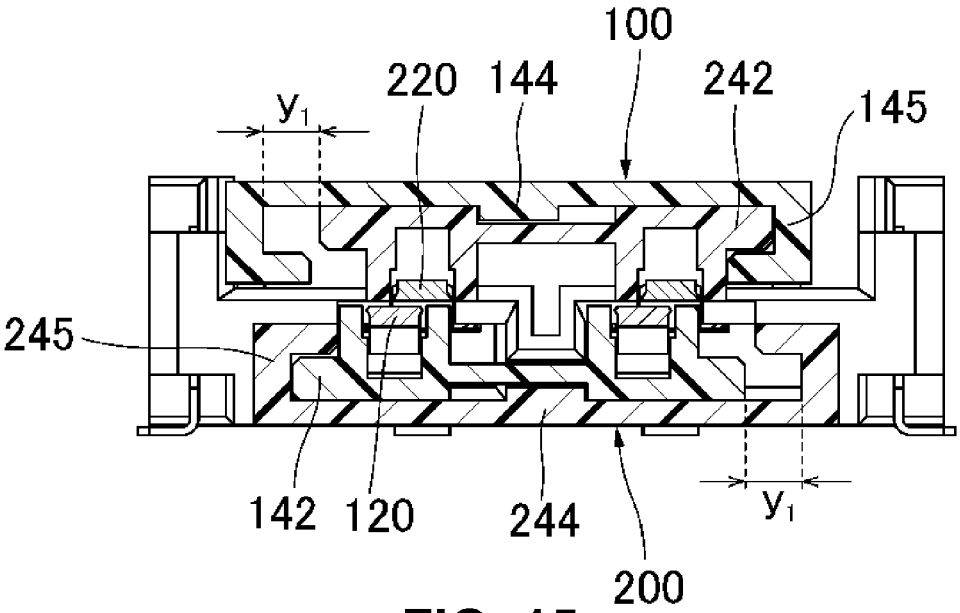
FIG. 15 is a schematic sectional view showing the electrical connector taken along a line 15-15 in FIG. 14 according to the embodiment of the present invention.

In the embodiment, after the electrical connector 100 is connected to the electrical connector 200 as shown in FIGS. 9 and 13, when the electrical connector 100 is shifted relative to the electrical connector 200 by a specific distance y1/2 in the left direction in the terminal arrangement direction, the electrical connector 100 and the electrical connector 200 are in a connection state as shown in FIGS. 14 and 15.

FIG. 14 is a schematic plane view showing the electrical connector the electrical connector 100 and the electrical connector 200 in the connection state that the electrical connector the electrical connector 100 is shifted relative to the electrical connector 200 (in the floating state in the left direction relative to the arrangement direction of the terminal) according to the embodiment of the present invention. FIG. 15 is a schematic sectional view showing the electrical connector 100 and the electrical connector 200 taken along a line 15-15 in FIG. 14 according to the embodiment of the present invention.

As shown in FIG. 15, when the electrical connector 100 is shifted relative to the electrical connector 200 by the specific distance y1/2 in the left direction in the terminal arrangement direction (the y axis direction), the side surface of the inner piece portion 142 of the electrical connector 100 abuts against the inner wall of the inner piece holding portion 245 of the electrical connector 200, and the side surface of the inner piece portion 242 of the electrical connector 200 abuts against the inner wall of the inner piece holding portion 145 of the electrical connector 100. Accordingly, the floating state of the electrical connector 100 and the electrical connector 200 in the terminal arrangement direction (the y axis direction) is restricted. In this state, the terminal 120 and the terminal 220 are arranged in the specific positional arrangement as shown in FIG. 18(*c*). As shown in FIG. 18(*c*), in this state, the contact portion 225 of the electrical connector 200 contacts with the contact region 123 of the electrical connector 100, and the contact portion 125 of the electrical connector 100 contacts with the contact region 223 of the electrical connector 200, so that the terminal 120 is electrically connected to the terminal 220 (the electrical connection between the terminal 120 and the terminal 220 is maintained).

Figure 16:
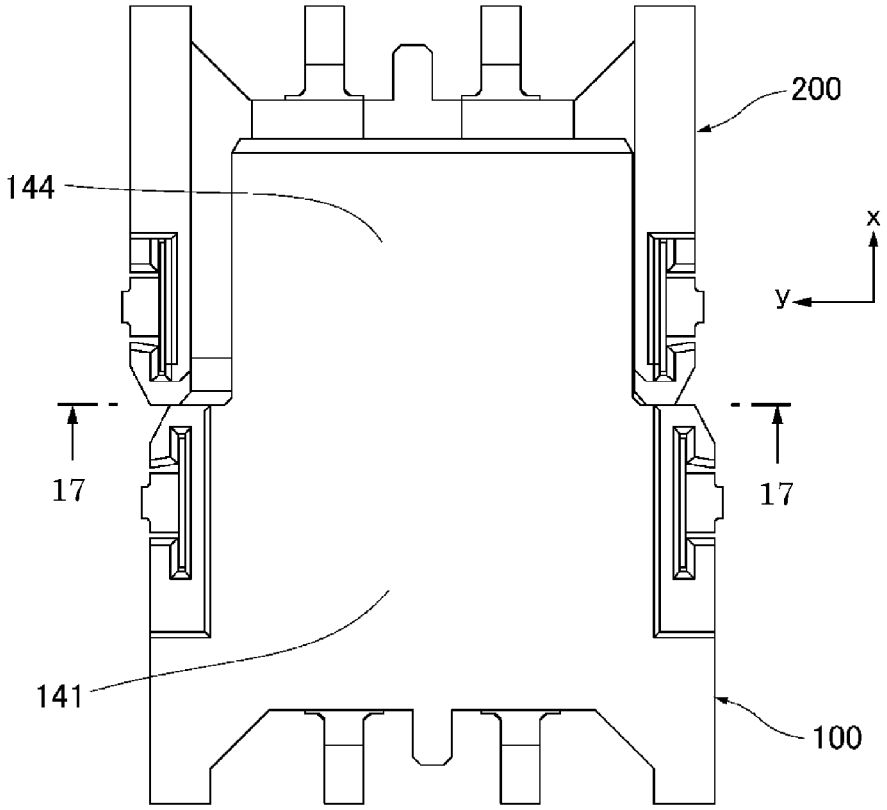
FIG. 16 is a schematic plane view showing the electrical connector in a connection state that the electrical connector is connected to another electrical connector (in a floating state in a right direction relative to the arrangement direction of the terminal) according to the embodiment of the present invention.
Figure 17:
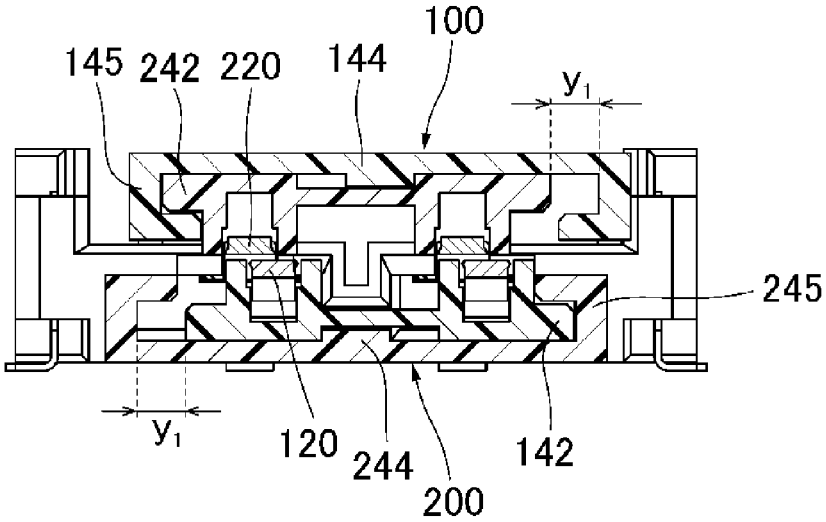
FIG. 17 is a schematic sectional view showing the electrical connector taken along a line 17-17 in FIG. 16 according to the embodiment of the present invention.

In the embodiment, after the electrical connector 100 is connected to the electrical connector 200 as shown in FIGS. 9 and 13, when the electrical connector 100 is shifted relative to the electrical connector 200 by a specific distance y1/2 in the right direction in the terminal arrangement direction, the electrical connector 100 and the electrical connector 200 are in a connection state as shown in FIGS. 16 and 17.

FIG. 16 is a schematic plane view showing the electrical connector the electrical connector 100 and the electrical connector 200 in the connection state that the electrical connector the electrical connector 100 is shifted relative to the electrical connector 200 (in the floating state in the right direction relative to the arrangement direction of the terminal) according to the embodiment of the present invention. FIG. 17 is a schematic sectional view showing the electrical connector 100 and the electrical connector 200 taken along a line 17-17 in FIG. 16 according to the embodiment of the present invention.

As shown in FIG. 17, when the electrical connector 100 is shifted relative to the electrical connector 200 by the specific distance y1/2 in the right direction in the terminal arrangement direction (the y axis direction), the side surface of the inner piece portion 142 of the electrical connector 100 abuts against the inner wall of the inner piece holding portion 245 of the electrical connector 200, and the side surface of the inner piece portion 242 of the electrical connector 200 abuts against the inner wall of the inner piece holding portion 145 of the electrical connector 100. Accordingly, the floating state of the electrical connector 100 and the electrical connector 200 in the terminal arrangement direction (the y axis direction) is restricted. In this state, the terminal 120 and the terminal 220 are arranged in the specific positional arrangement as shown in FIG. 18(*d*). As shown in FIG. 18(*d*), in this state, the contact portion 225 of the electrical connector 200 contacts with the contact region 123 of the electrical connector 100, and the contact portion 125 of the electrical connector 100 contacts with the contact region 223 of the electrical connector 200, so that the terminal 120 is electrically connected to the terminal 220 (the electrical connection between the terminal 120 and the terminal 220 is maintained).

As described above, in the embodiment, when the electrical connector 100 is connected to the electrical connector 200, the electrical connector 100 is capable of shifting relative to the electrical connector 200 by the distance y1 as the movable range in the terminal arrangement direction (the y axis direction). Further, the contact region 123 of the terminal 120 and the contact region 223 and the terminal 220 have the width greater than the distance y1 in the terminal arrangement direction (the width direction) and the distance x1 in the connecting direction (the longitudinal direction). Accordingly, it is possible to maintain the electrical connection between the terminal 120 and the terminal 220 in the floating state. In other words, when the electrical connector 100 is connected to the electrical connector 200, the movable range (x1, y1) is defined by the positions of the protruding portion 147, the protruding portion 149, the protruding portion 247, and the protruding portion 249; the distances between the inner piece portion 142 or the inner piece portion 242 and the inner piece holding portion 145 of the outer piece portion 144 or the inner piece holding portion 245 of the outer piece portion 244; and the sizes of the contact region 123 of the terminal 120 and the contact region 223 and the terminal 220.

As described above, in the electrical connector 100 and the electrical connector 200 in the embodiment, when the electrical connector 100 is connected to the electrical connector 200, the electrical connector 100 is capable of shifting relative to the electrical connector 200 within the specific range while maintaining the electrical connection between the terminal 120 and the terminal 220. Accordingly, it is possible to freely dispose the electrical connector 100 and the electrical connector 200 on the circuit board 300 and the circuit board 400 to a greater extent.

As described above, in the embodiment, the electrical connector 100 and the electrical connector 200 are the male connector and the female connector having the substantially same shape. Accordingly, it is possible to produce the electrical connector 100 and the electrical connector 200 using the same mold and share the manufacturing equipment, thereby making it easy to produce and reduce the manufacturing cost. Further, it is possible to reduce the number of the components, thereby making it possible to assemble easily and reduce the assembly cost.

The disclosure of Japanese Patent Application No. 2013-064004, filed on Mar. 26, 2013, is incorporated in the application.

While the invention has been explained with reference to the specific embodiments of the invention, the explanation is illustrative and the invention is limited only by the appended claims.

What is claimed is:

1. An electrical connector to be connected to a mating electrical connector in a connecting direction, comprising:

a terminal; and a housing for holding the terminal, wherein said terminal includes a board connecting portion to be connected to a board; a holding portion fixed to the housing; a contact region for contacting a mating contact portion of the mating electrical connector; a contact piece capable of elastically deforming; and a contact portion formed at a distal end portion of the contact piece, said housing includes an inner piece portion and an outer piece portion protruding in the connecting direction, said contact piece is disposed between the inner piece portion and the outer piece portion, said outer piece portion includes inner piece holding portions at both sides thereof, and said inner piece holding portions are away from each other by a distance greater than a width of the inner piece portion.

2. The electrical connector according to claim 1, wherein each of said inner piece holding portions is formed in an open rectangular shape.

3. The electrical connector according to claim 1, wherein said inner piece holding portions are configured to receive a mating inner piece portion of the mating electrical connector when the electrical connector is connected to the mating electrical connector, and said outer piece portion is configured to be accommodated in mating inner piece holding portions of the mating electrical connector when the electrical connector is connected to the mating electrical connector.

4. The electrical connector according to claim 1, wherein said contact region is configured to define a range that the electrical connector can shift relative to the mating electrical connector when the electrical connector is connected to the mating electrical connector.

5. The electrical connector according to claim 1, wherein said outer piece portion further includes a first protruding portion and a second protruding portion for abutting against the mating electrical connector when the electrical connector is disconnected from the mating electrical connector.

6. The electrical connector according to claim 1, wherein said holding portion includes a first protrusion for fixing the terminal relative to the housing and a second protrusion for positioning the terminal relative to the housing.

* * * * *